United States Patent [19]

Coffey et al.

[11] Patent Number: 4,704,596

[45] Date of Patent: Nov. 3, 1987

[54] EXTRUSION COATED IGNITION WIRE

[75] Inventors: Ronald J. Coffey, Lafayette; Christo M. Wassouf, West Lafayette, both of Ind.

[73] Assignee: Essex Group, Inc., Fort Wayne, Ind.

[21] Appl. No.: 933,653

[22] Filed: Nov. 19, 1986

[51] Int. Cl.[4] ..... H01C 3/06

[52] U.S. Cl. ..... 338/214; 174/102 SC; 174/170 SC; 338/66

[58] Field of Search ..... 338/214, 66; 174/120 SC, 102 SC, 105 SC, 113 C, 131 A; 252/511

[56] References Cited

U.S. PATENT DOCUMENTS

| | | | |
|---|---|---|---|
| 3,284,751 | 11/1966 | Barker et al. | 338/214 X |
| 3,680,027 | 7/1972 | Vitale | 338/214 |
| 3,692,925 | 9/1972 | Kindij | 174/110 PM |
| 3,697,670 | 10/1972 | Mitacek | 174/110 PM X |
| 3,818,412 | 6/1974 | Deardurff | 338/214 |
| 3,870,987 | 3/1975 | Wiley et al. | 338/214 |
| 4,209,425 | 6/1980 | Lin et al. | 174/120 SC |
| 4,342,880 | 8/1982 | Castelli et al. | 174/120 SC X |

*Primary Examiner*—C. L. Albritton

*Attorney, Agent, or Firm*—Harry J. Gwinnell

[57] ABSTRACT

Automotive ignition wire with a high temperature rating, excellent electrical insulating properties, heat resistance, oil resistance and abrasion resistance is described. The wire utilizes a conductor made up of a glass fiber-cotton fiber braid on a graphite impregnated glass layer. Overcoating the conductor is an adhesion promoting polymer layer, an extruded thermosetting semiconducting polymer layer overcoated with a glass braid layer and a polymer jacket material. The polymer jacket material comprises a polymeric mixture of ethylene vinyl acetate and ethylene-propylene-diene monomer stabilized with a mixture of a phenolic antioxidant and a metal salt antioxidant.

6 Claims, 1 Drawing Figure

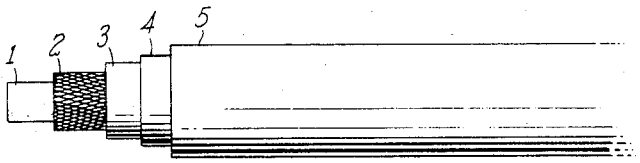
1
2
3
4
5

EXTRUSION COATED IGNITION WIRE

CROSS REFERENCE TO RELATED APPLICATIONS

Attention is directed to commonly assigned, copending U.S. patent application Ser. No. 889,158 entitled "Ignition Wire", filed on July 25, 1986, and Ser. No. 900,101 entitled "Multi-layer Ignition Wire", filed on Aug. 25, 1986.

TECHNICAL FIELD

The field of art to which this invention pertains is insulated electrical conductors, and specifically ignition wire.

BACKGROUND ART

In the electrical conductor art, in addition to electrical insulating properties, consideration is also given to physical properties provided by particular insulation material, and depending on the particular use such insulated wires are to be put, the physical property requirements can be quite demanding.

In the automotive area, for example with ignition wire, the physical requirements for the wire are particularly severe. In addition to insulating ability, the wire must be capable of extreme heat aging and oil resistance as well.

And of course, while extreme physical properties are obtainable, in view of the significant amounts of wire used for this purpose in the automotive industry, manufacturing costs can be a significant consideration.

Accordingly, there is a constant search in this art for insulating materials for automotive ignition wire which have the requisite combination of insulating properties, physical properties, and reasonable costs to produce.

DISCLOSURE OF INVENTION

The present invention is directed to a multilayer electrically conducting ignition wire of simplified construction. The wire comprises a graphite impregnated glass fiber bundle core wrapped in a glass fiber containing braid material. On the braid material is coated an adhesion promoting polymer layer. On the polymer layer is extruded a layer of thermosetting semiconducting polymer material which has extruded over it improved jacketing material as the outermost layer. The jacketing material comprises a blend of ethylene-propylene-diene monomer with ethylene vinyl acetate, stabilized with a mixture of phenolic antioxidant and a metal salt antioxidant.

Another aspect of the invention is a method of producing such wire by starting with the graphite impregated glass fiber bundle core and overbrading a glass containing braid material. An adhesion promoting polymer layer is coated on the braid layer. A thermosetting semiconducting polymer material is then extruded over the top of the adhesion layer and the above-described jacketing material is extruded over the thermosetting semiconducting polymer layer.

The foregoing, and other features and advantages of the present invention will become more apparent from the following description and accompanying drawing.

BRIEF DESCRIPTION OF THE DRAWING

The FIGURE shows a jacketed wire according to the present invention.

BEST MODE FOR CARRYING OUT THE INVENTION

In the FIGURE the conductor 1 is a glass fiber bundle impregnated with carbon particles. Such a conductor is conventionally used in this art and is available, for example, from Jonathan Temple (as a 60 end 150/1/0 roving carbon impregated glass). The glass braid 2 applied to the graphite impregnated glass is typically a mixture of interwoven cotton thread and glass used in equal amounts, as is also conventionally used in this art. Over this glass braid is applied a (dip coated) layer of adhesive 3 to improve the adhesion between the glass braid and the subsequently applied thermosetting semiconducting polymer layer 3. This adhesive is any conventional adhesion promoter such as Chemlok TM adhesive available from Hughson Chemicals. As stated, over this adhesive layer is extrusion coated a layer of thermosetting semiconducting polymer. Any thermosetting semiconducting polymer material which provides a smooth layer over the conductor to reduce or alleviate conductor imperfections (such as burrs, spikes, etc.) that may give rise to excessive voltage gradients causing premature electrical failure can be used. Particularly preferred is a methyl vinyl silicone material (such as General Electric 25082) containing conductive carbon black. This material is typically extruded through a 4.5 inch Royal extruder at about 12±4 mils thickness at a speed 500–1000 feet per minute (fpm). It is then cured in a conventional continuous vulcanizer (C.V.) at a rate of about 500–1000 fpm.

The final layer is the polymer jacket layer. This layer comprises a mixture of ethylene-propylene-diene monomer (EPDM) with ethylene vinyl acetate (EVA) copolymer and a mixture of a phenolic antioxidant and a metal salt antioxidant. The ethylene-propylene-diene monomer typically comprises 68% ethylene, and 32% propylene with a small amount of nonconjugated diene termonomer for cross-linking. This material is commerically available from Uniroyal as Royalene TM 512. The ethylene vinyl acetate copolymer typically contains 40% by weight vinyl acetate and can be obtained from E. I. DuPont deNemours as Elvax TM 40. The EPDM provides electrically insulating properties, particularly low specific inductive capacity, high dielectric breakage voltage, and low dissipation factor. The ethylene vinyl acetate provides physical properties such as high oil resistance. The ethylene vinyl acetate typically has a melt index of 48–66 (ASTM D1238). The EPDM is typically high viscosity, the diene component providing a cross-linking function and the ethylene component providing crystallinity, the overall blend being workable and typically having a viscosity of 60 Mooney (ML 1+4) at 125° C. The amount of vinyl acetate used can be less than the 40% with a sacrifice in some of the physical properties, such as oil resistance.

To produce a satisfactory blend of physical and electrical properties the EPDM and EVA polymers are typically used in about equal proportions. Natually one skilled in this art may vary from this ratio with concurrent decrease in either insulating or physical properties. The composition is typically mixed so as to have a viscosity of between 10 and 20 inch pounds at 380° F. using a Monsanto Rheometer with 3° arc at 900 cycles per minutes. This provides a composition suitable for extrusion application.

As stated above, the equal amounts (based on parts by weight) provides processability, oil resistance, heat resistance, and insulating properties suitable for commercial applications.

As the antioxidant any phenolic antioxidant and metal salt mixture can be used with a hindered alkylated phenol and zinc mercaptotolylimidazole being preferred (e.g. Ciba Geigy's Irganox 1035 and RT Vanderbuilt Vanox ZMTI or Mobay's ZMB-2 respectively).

Typically these materials are used at about 3.5% by weight based on total weight of the jacket material. The order of mixing of the components of the jacket material is not critical. Typically the materials are mixed in a size 11 Farrel mixer to about 75% loading capacity. The materials are mixed for about 10 minutes at room temperature and extruded typically at about 190° F. to about 200° F.

The article of the type disclosed in the FIGURE is typically made by dip coating the adhesive out of a conventional solvent or water based solution using a conventional dip coating tower oven operation. The thermosetting semiconducting polymer layer and the jacket material are extruded using commercially available extrusion equipment such as a John Royal extruder. The glass fiber braid can be applied using commerically available braiding equipment such as a Wardwell braider.

EXAMPLE I

A carbon impregnated glass roving obtained from Jonathan Temple as 60N/150/1/0 was overbraided with 4 carriers of 60-2-2 cotton thread and 4 carriers of 150/1/0-3 glass using a Wardwell braider. The graphite impregnated glass had a diameter of 75 mils after wrapping with the glass fiber braid. An approximately 1 mil thick coating was applied by dip coating with a layer of Chemlok 234B adhesive. The adhesive layer was dried in a tower oven. A layer of methyl vinyl silicone thermosetting semiconducting polymer containing conductive carbon black (GE 25082) was extruded over the adhesive layer at a thickness of about 12 mils, using a John Royal 4.5 inch, 20/1 (length/diameter) extruder. This layer is next cured at 500–1000 fpm in a 300 foot long C.V. tube using a steam pressure of 250 pounds per square inch gauge (psig) and a water length of 40–60 feet. Finally, the jacket material (ethylene vinyl acetate containing 40% by weight vinyl acetate stabilized with 3.5% of a mixture of hindered alkylated phenol and zinc mercaptotolylimidazole at a ratio of 1:2) is extruded over the glass fiber using the same John Royal extruder. The jacketed conductor was then cured in a C.V. tube having a cure time in a 300 foot long tube of about 1.5 minutes at 250 psig steam pressure. The extruded polymer jacket resulted in a wire with a 315 mil diameter.

EXAMPLE II

The jacket material used in Example I above has been made with the following composition.

| Materials | Parts | Wt. % |
|---|---|---|
| EPDM (Royalene 512) | 50 | 23.791 |
| Elvax 40 (EVA-40% by weight) | 50 | 23.791 |
| Zinc Oxide (Cure Activator) | 5 | 2.379 |
| Paraffin Wax (Processing Aid) | 5 | 2.379 |
| Low Molecular Weight Polyethene (Processing Aid, Allied AC617A) | 2 | 0.952 |
| Hydrated Alumina (Hydral 710) (High Temperature Filler) | 50 | 23.791 |
| Talc (Reinforcing Filler) | 30 | 14.275 |
| Coagent (Ware C 416) | 6.66 | 3.169 |
| Vinyl Silane (Adhesion Promoter) | 1 | 0.476 |
| Phenolic Antioxidant (Irganox 1035) | 3 | 1.427 |
| Metal Salt Antioxidant (ZMB-2) | 6 | 2.855 |
| Fatty Acid Salt (Processing Aid, Vanfre AP-2) | 1.5 | 0.715 |

The above composition is strained and screened to remove impurities and then mixed with a peroxide curing agent (Vulcup TM R, Hercules) at 2 parts by weight (0.93%) and various pigments added for color at 3 parts by weight (1.394%).

Various fillers, processing aids, coagents, curing agents, etc. can be added to the jacket material to aid in processing and curing. This includes such things as paraffin wax, polyethylene, vinylsilanes, peroxides, fillers such as talc and hydrated alumina, etc.

In addition to lower cost than conventional silicone jacket material used in this environment, the polymer jacket according to the present invention has at least a 275° F. SAE J557 rating and in fact the material shown in the FIGURE has a 400° F. rating. Furthermore, the material has excellent electrical insulating properties, heat resistance, oil resistance, and abrasion resistance. Use of fewer layers then constructions conventionally used in this art, and the ability to apply these layers by extrusion, with no significant loss of critical physical or electrical properties, positively effects both the efficiency and costs of manufacture.

Although this invention has been shown and described with respect to detailed embodiments thereof, it will be understood by those skilled in the art that various changes in form and detail thereof may be made without departing from the spirit and scope of the claimed invention.

We claim:

1. Electrically conductive ignition wire comprising a graphite impregnated glass fiber core overbraided with a glass and cotton fiber braid, which is overcoated with an adhesion promoting polymer layer, an extruded layer of thermosetting semiconducting polymer, and a polymer jacket layer extruded over the thermosetting semiconducting polymer layer, the polymer jacket comprising a mixture of ethylene-propylene-diene monomer containing polymer with ethylene vinyl acetate stabilized with a mixture of a phenolic antioxidant and a metal salt antioxidant.

2. The wire of claim 1 wherein the ethylene vinyl acetate polymer contains 40% by weight vinyl acetate and the antioxidant mixture is present in an amount of about 3.5% by weight and the weight ratio of phenolic antioxidant to metal salt antioxidant is about 1:2.

3. The wire of claim 2 wherein the thermosetting semiconducting polymer layer is a methyl vinyl silicone.

4. The method of making electrically conductive ignition wire comprising overbrading a graphite impregnated glass fiber core with a glass and cotton fiber braid, overcoating the braid with an adhesion promoting polymer layer, extruding a layer of thermosetting semiconducting polymer on the adhesion promoting polymer layer, extruding a polymer jacket layer over the thermosetting semiconducting polymer layer, the polymer jacket comprising a mixture of ethylene-propylene-diene-monomer containing polymer with ethylene vinyl acetate stabilized with a mixture of phenolic antioxidant and a metal salt antioxidant.

5. The method of claim 4 wherein the ethylene vinyl acetate polymer contains 40% by weight vinyl acetate and the antioxidant mixture is present in an amount of about 3.5% by weight and the weight ratio of phenolic antioxidant to metal salt antioxidant is about 1:2.

6. The method of claim 5 wherein the thermosetting semiconducting polymer layer is a methyl vinyl silicone.

* * * * *